US006746182B2

(12) United States Patent
Munk et al.

(10) Patent No.: US 6,746,182 B2
(45) Date of Patent: Jun. 8, 2004

(54) KEEL JOINT ARRANGEMENTS FOR FLOATING PLATFORMS

(75) Inventors: Brian N. Munk, Houston, TX (US); Joseph W. Pallini, Tomball, TX (US); Gary R. Stonesifer, Pasadena, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/207,296

(22) Filed: Jul. 29, 2002

(65) Prior Publication Data

US 2003/0021634 A1 Jan. 30, 2003

Related U.S. Application Data

(60) Provisional application No. 60/308,365, filed on Jul. 27, 2001.

(51) Int. Cl.[7] ..... E21B 17/01; B63B 35/44

(52) U.S. Cl. ..... 405/224.2; 405/224; 166/350; 166/367

(58) Field of Search ..... 405/166, 167, 405/168.4, 224.2, 224.3, 224.4; 166/350, 355, 367; 175/5–7

(56) References Cited

U.S. PATENT DOCUMENTS 3,389,563 A * 6/1968 Postlewaite et al. ..... 405/166
3,581,506 A * 6/1971 Howard ..... 405/166
3,602,175 A * 8/1971 Morgan et al. ..... 405/224.2
4,486,123 A * 12/1984 Koch et al. ..... 405/169
5,683,205 A 11/1997 Halkyard
5,873,677 A * 2/1999 Davies et al. ..... 405/195.1
5,881,815 A * 3/1999 Horton, III ..... 166/350
5,887,659 A * 3/1999 Watkins ..... 166/350
6,213,686 B1 * 4/2001 Baugh ..... 405/166
6,422,791 B1 * 7/2002 Pallini et al. ..... 405/224.2

FOREIGN PATENT DOCUMENTS

GB 2152977 * 8/1985 ..... 166/367

* cited by examiner

*Primary Examiner*—Jong-Suk (James) Lee
(74) *Attorney, Agent, or Firm*—Bracewell & Patterson, L.L.P.

(57) ABSTRACT

Keel joint assemblies are described that permit a degree of rotational movement of a riser within the keel of a floating vessel and greatly reduce the amount of stress and strain that is placed upon the riser, as well. Keel joint assemblies described provide a limiting joint between the riser and the keel opening that permits some angular rotation of the riser with respect to the floating vessel. Additionally, the limiting joint permits the riser to move upwardly and downwardly within the keel opening, but centralizes the riser with respect to the keel opening so that the riser cannot move horizontally with respect to the keel opening. In described embodiments, the limiting joint is provided by a single annular joint that allows that riser to move angularly with respect to the can. In some embodiments, the keel joint assembly incorporates a cylindrical stiffening can that radially surrounds a portion of the riser and is disposed within the keel opening. In these embodiments, a flexible joint is provided between the can and the riser. Supports or guides may be used to retain the can within the keel opening.

11 Claims, 4 Drawing Sheets

KEEL JOINT ARRANGEMENTS FOR FLOATING PLATFORMS

CROSS-REFERENCE TO RELATED APPLICATIONS

This application claims the priority of provisional patent application serial No. 60/308,365 filed Jul. 27, 2001.

BACKGROUND OF THE INVENTION

1. Field of the Invention

The invention relates generally to methods and devices for providing a stress-relieving joint between a riser and the keel of a floating platform.

2. Description of the Related Art

Deep water floating platforms use risers to communicate production fluid from the sea floor to the floating production platform. Floating platforms have a portion that lies below the surface of the sea. For stability of the platform, it is desired that there be a very deep draft. The spar, for example, is a popular style of floating platform that has an elongated, cylindrical hull portion which, when deployed, extends downwardly a significant distance into the sea. The lowest portion of the submerged hull is referred to as the keel. Currents in the sea tend to move the floating platform laterally across the sea surface. Despite the presence of anchorages, the platform imparts bending stresses to the riser during lateral movement. Localized, or point, stresses are particularly problematic for risers.

One known joint arrangement for use with risers and floating vessels is described in U.S. Pat. No. 5,683,205 issued to Halkyard. Halkyard describes an arrangement wherein a joint means is positioned within a keel opening in the floating vessel to reduce the amount of stress upon a pipe passing through the keel opening. The joint means consists of a radially enlarged sleeve member with an elastomeric annulus at either end that is in contact with both the sleeve member and the pipe. Halkyard's intent is to reduce stress upon the pipe that is imposed by lateral movement of the floating vessel upon the sea. In order to reduce stress, Halkyard contacts the pipe at two points with an elastomeric annulus, which is described as providing a resilient, somewhat yieldable connection. Unfortunately, Halkyard's arrangement is problematic since it permits almost no angular movement of the pipe within the sleeve member. While point stresses upon the pipe are reduced, they are still significant. Further, the pipe is required to bend within the confines of the sleeve. This bending, together with the induced point stresses at either end of the sleeve, place significant strain on the pipe.

The present invention addresses the problems in the prior art.

SUMMARY OF THE INVENTION

Keel joint assemblies are described that permit a degree of rotational movement of a riser within the keel of a floating vessel. The assemblies of the present invention greatly reduce the amount of stress and strain that is placed upon the riser, as well. The present invention describes keel joint assemblies that provide a limiting joint between the riser and the keel opening that permits some angular rotation of the riser with respect to the floating vessel. Additionally, the limiting joint permits the riser to move upwardly and downwardly within the keel opening, but centralizes the riser with respect to the keel opening so that the riser cannot move horizontally with respect to the keel opening.

In described embodiments, the limiting joint is provided by a single annular joint that allows that riser to move angularly with respect to the can. In some embodiments, the keel joint assembly incorporates a cylindrical stiffening can that radially surrounds a portion of the riser and is disposed within the keel opening. In these embodiments, a flexible joint is provided between the can and the riser. Supports or guides may be used to retain the can within the keel opening.

DETAILED DESCRIPTION OF THE PREFERRED EMBODIMENTS

Figure 1:
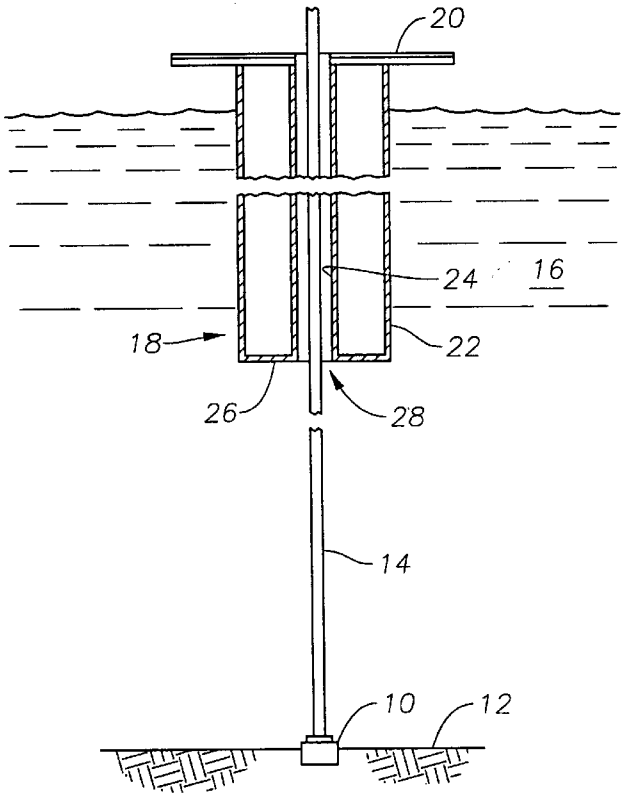
FIG. 1 illustrates an exemplary riser extending upwardly from the sea floor and through a spar-type floating platform.

FIG. 1 generally illustrates a subsea wellhead 10 that has been installed into the sea floor 12. A riser 14 is connected to the wellhead 10 and extends upwardly through the waterline 16 to a floating platform 18. The riser 14 is used to transmit production fluids or as a drilling conduit from the wellhead 10 to production facilities (not shown) on the floating platform 18. The riser 14 is used to provide a closed conduit from the wellhead 10 to the floating platform 18. The floating platform 18 shown is a spar-type floating vessel that carries production equipment (not shown) on an upper deck 20. The hull 22 of the platform 18 is a cylinder having flotation chambers within and a central, vertically-oriented passage 24 through which the riser 14 is disposed. It is noted that the configuration for a passage used in floating platforms varies from platform to platform. Sometimes the passage is lined by a cylindrical wall that extends substantially the entire length of the hull. In other platforms, the passage is partially lined by such a wall, and in still other platforms, there is essentially no lining for the passage. The keel 26 is located at the lower end of the hull 22. A keel joint, indicated generally at 28, is used to permit axial upward and downward motion as well as angular deflection of the riser 14 with respect to the keel 26. It is desired that the keel joint 28 be constructed to preclude localized bending stresses in the riser 14 that could damage it, resulting in structural failure of the riser 14.

Figure 2:
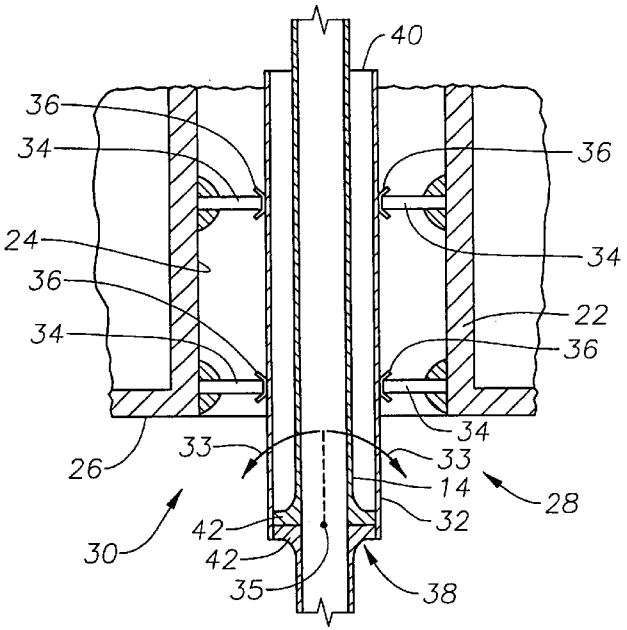
FIG. 2 is a schematic side, cross-sectional view of a first exemplary keel joint assembly constructed in accordance with the present invention.

Referring to FIG. 2, there is shown a first, and currently most preferred, exemplary keel joint arrangement 30 that can be used as the keel joint 28 to support the riser 14. The keel joint arrangement 30 includes a stiff cylindrical can 32 that radially surrounds a portion of the riser 14. The can 32 is retained within and disposed away from the walls of the keel opening or passage 24 by supports or guides 34 that are securely affixed with the hull 22. While there are only two upper and two lower supports 34 shown in FIG. 2, it should be understood that there are actually more such supports 34, perhaps four or more upper and four or more lower supports 34 and that the supports are located to surround the circumference of the riser 14. The supports 34 have rounded, non-puncturing ends 36 to contact the outer wall of the can 32. It is noted that the supports 34 are not affixed to the can 32, thereby permitting the can 32 to move upwardly and downwardly within the passage 24. The keel joint arrangement 30 maybe thought of an "open can" arrangement since the can 32 is affixed to the riser 14 by a stress joint (straight or tapered) 38 proximate the lower end of the can 32 while the upper end 40 of the can 32 is not secured to or maintained in contact with the riser 14. The exemplary stress joint 38 illustrated consists of a pair of radially enlarged collars 42 that surround the riser 14 and are affixed to the inner radial surface of the can 32. The collars 42 are shown to be fashioned of metal. However, the collars 42 may also be fashioned of a suitable elastomeric material. The collars 42 may be substantially rigid so as to permit a small amount of angular movement of the riser 14 with respect to the can 32. Alternatively, the collars 42 may be relatively flexible to permit additional angular movement.

In operation, the riser 14 can move angularly to a degree within the can 32 under bending stresses. Illustrative directions of such relative angular movement are shown in FIG. 2 by arrows 33 about rotation point 35. During such angular movement, the outer walls of the riser 14 are moved closer to or further away from the inner walls of the keel opening 24. The stress joint 38 forms a fulcrum. The can 32 is stiff enough that it transfers stresses directly from the stress joint 38 to the supports 34, thereby preventing any significant stresses from being seen by the upper portion of the riser 14. Generally, this arrangement allows the upper portion of the riser 14 to have a smaller cross section than the stress joint 38.

Figure 3:
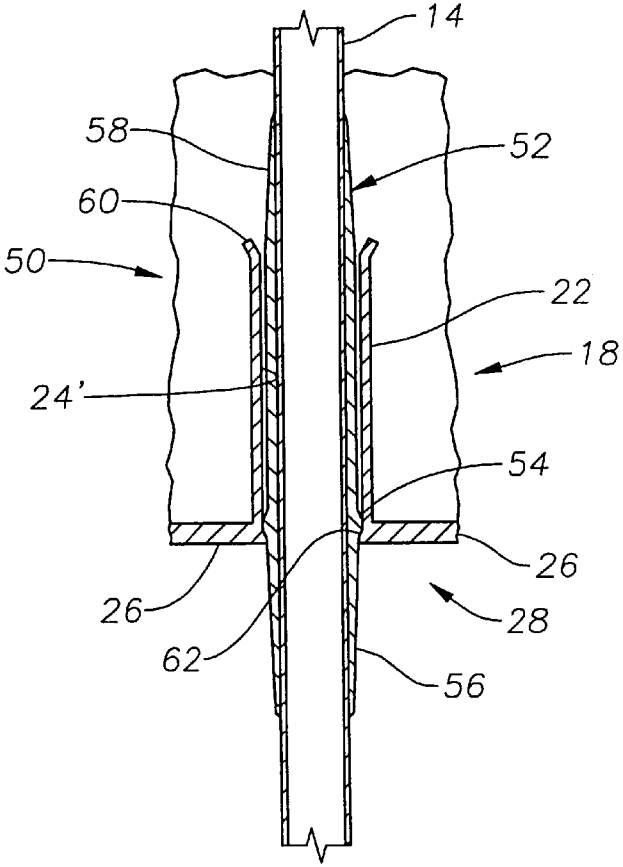
FIG. 3 is a schematic side, cross-sectional view of a second exemplary keel joint assembly constructed in accordance with the present invention.

FIG. 3 illustrates an alternative embodiment for a keel joint arrangement 50 that is useful as a keel joint 28. In the keel joint arrangement 50, a heavy walled wear sleeve 52 radially surrounds a portion of the riser 14. The wear sleeve 52 may or may not be secured to the riser 14 in a fixed relation, such as by the use of welding or retaining rings such as are known in the art. A central portion of the wear sleeve 52 has an external annular ring 54 that extends radially outwardly and forms the portion of the sleeve 52 having the largest exterior diameter. The ring 54 presents an outer radial surface that is vertically curved in a convex manner. The outer radial surface of the ring 54 may also be frustoconical in shape. Below the annular ring 54 is a lower inwardly tapered portion 56. Above the ring 54 is an upper inwardly tapered portion 58. A partially-lined passage, designated as 24', in the hull 22 of the floating vessel 18 has an open upper end 60 that is outwardly flared for installation purposes. The flare of the upper end assists in guiding the sleeve 52 and ring 54 into place when lowering the riser 14 through the hull 22. The lower end of the passage 24 has an annular recess 62 that is sized and shaped for the annular ring 54 to reside within. The recess 62 presents an inner surface that is vertically curved in a concave manner so that the outer convex surface of the annular ring 54 can be matingly engaged. If the outer radial surface of the ring 54 is frustoconical in shape, however, the inner surface of the recess 62 will be made complimentary to that frustoconical shape.

In operation, the keel joint arrangement 50 helps to prevent damage to the riser 14 from bending stresses. The wear sleeve 52 is located at the keel 26 where the primary bending stresses are imparted to the riser 14 and, therefore, is designed to absorb most of those stresses and prevent them from being imparted directly to the riser 14. The interface of the ring 54 and the recess 62 provides a fulcrum wherein the riser 14 can move angularly with respect to the hull 22. In addition, the elongated upper tapered portion 58 will tend to bear against the length of the passage 24', thereby reducing or eliminating localized, or point, stresses.

Figure 4:
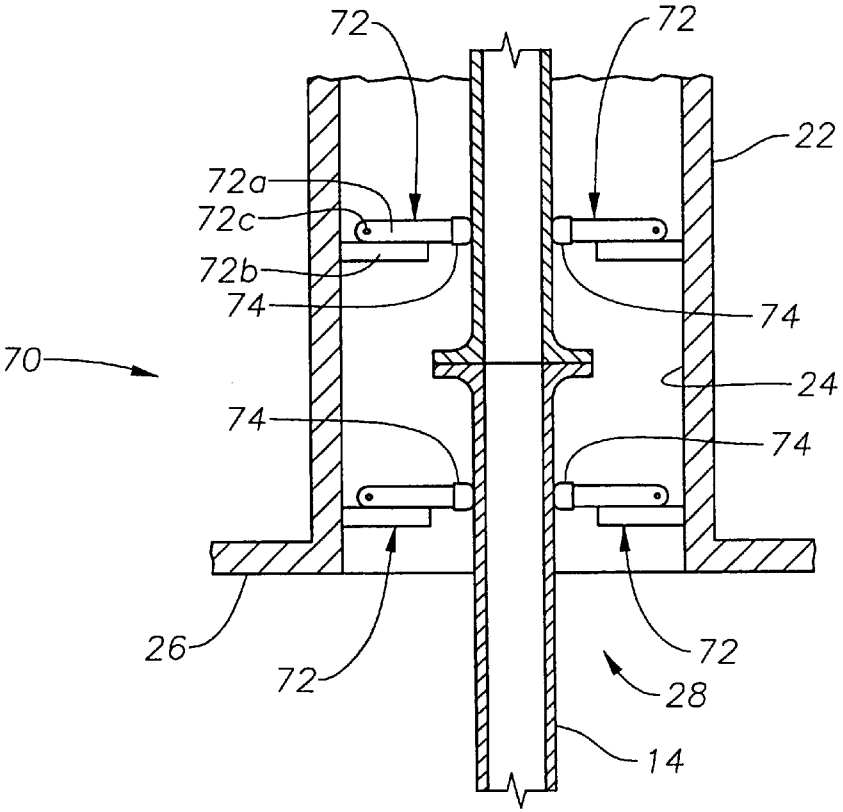
FIG. 4 is a schematic side, cross-sectional view of a third exemplary keel joint assembly constructed in accordance with the present invention.

Referring now to FIG. 4, there is shown a keel joint arrangement 70, which is a second alternative embodiment that is useful as the keel joint 28. The keel joint arrangement 70 employs centralizer assemblies 72 that are secured within the passage 24 of the hull 22. Preferably, the centralizer assemblies 72 are spaced angularly about the circumference of the passage 24. In a preferred embodiment, the centralizers 72 comprise hydraulically actuated piston-type assemblies, the piston arrangement being illustrated schematically by two 72*a*, 72*b*. In practice, the two arms 72*a*, 72*b* would be nested one within the other in a piston fashion and would be selectively moveably with respect to one another. In an alternative embodiment, the centralizer assemblies 72 comprise hinged assemblies wherein the two arms 72*a*, 72*b* are hingedly affixed to one another at hinge point 72*c*. Actuation of the centralizer assembly in this case would move the arm 72*a* angularly with respect to the arm 72*b* about the hinge point 72*c*, thereby permitting the arm 72*a* to be selectively moved into and out of engagement with the riser 14. The centralizers 72 are energized via hydraulic lines (not shown) to urge the riser toward the radial center of the passage 24 to resist contact between the riser 14 and the passage 24. The centralizers 72 have rounded, non-puncturing tips 74 that bear upon the riser 14. Preferably, the non-puncturing tips comprise either wear pads or rollers for engagement of the riser 14. It is noted that the piston-type centralizer assemblies 72 may be actuated mechanically rather than hydraulically. Also, the centralizer assemblies' attachments to the passage 24 may be softened, such as through use of springs or rubber, in such a way as to decrease bending stresses by yielding to riser deflection. In a further alternative embodiment, the centralizers 72 will comprise members that have a hinged attachment to the passage 24.

Figure 5:
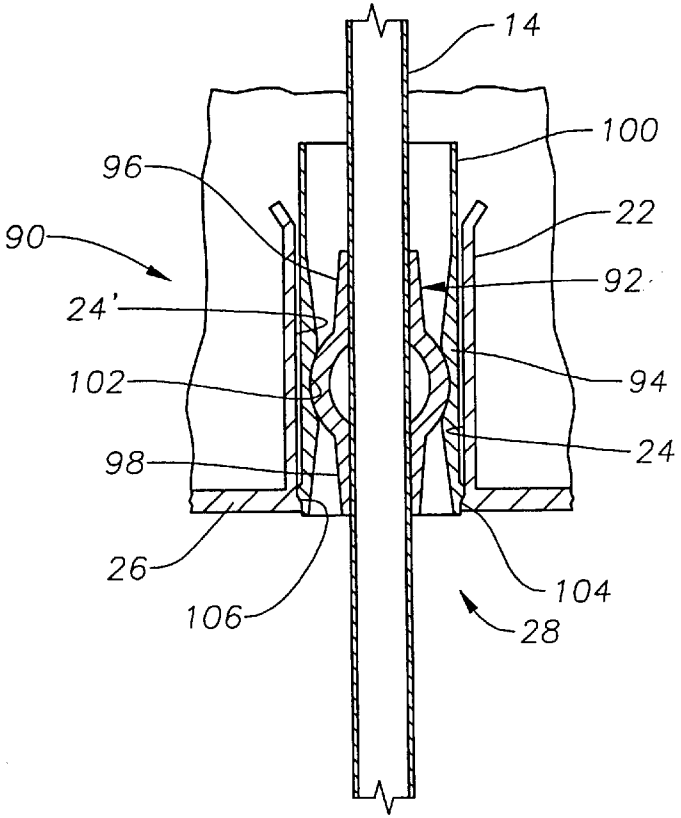
FIG. 5 is a schematic side, cross-sectional view of a fourth exemplary keel joint constructed in accordance with the present invention.

FIG. 5 depicts a third alternative embodiment for the keel joint 28. Keel joint assembly 90 includes a riser collar 92 that surrounds a portion of the riser 14 proximate the keel 26. The collar 92 is not affixed to the riser 14 but instead permits sliding movement of the riser 14 upwardly and downwardly through the collar 92. The collar 92 is generally cylindrical but includes a bulbous central portion 94 and two tapered end portions 96, 98. A guide sleeve 100 radially surrounds the collar 92 and features an interior rounded profile 102 that is shaped and sized to receive the bulbous portion 94 of the collar 92. An exterior landing profile 104 is located at the lower end of the guide sleeve and is shaped and sized to form a complementary fit with a landing profile 106 formed into the keel 26. The passage 24' is constructed identically to the passage 24' described earlier in that it has an open upper end with an outward flare.

To assemble the keel joint arrangement 90, the collar 92 and guide sleeve 100 are assembled onto the riser 14. Then the riser 14 is run through the passage 24' and the landing profile 104 of the guide sleeve 100 is seated into the matching profile 106 in the keel 26. In operation, the riser 14 can slide upwardly and downwardly within the collar 92 as necessary to compensate for movement of the floating platform 18. Rotation of the platform 18 with respect to the riser 14 is permitted between the riser 14 and the collar 92 as well as between the collar 92 and the guide sleeve 100. Angular movement of the riser 14 with respect to the platform 18 is accommodated by rotation of the bulbous portion 94 within the rounded profile 102 of the guide sleeve 100. Alternatively, a rubberized flex joint of a type known in the art (not shown) might be used to accommodate angular rotation.

Figure 6:
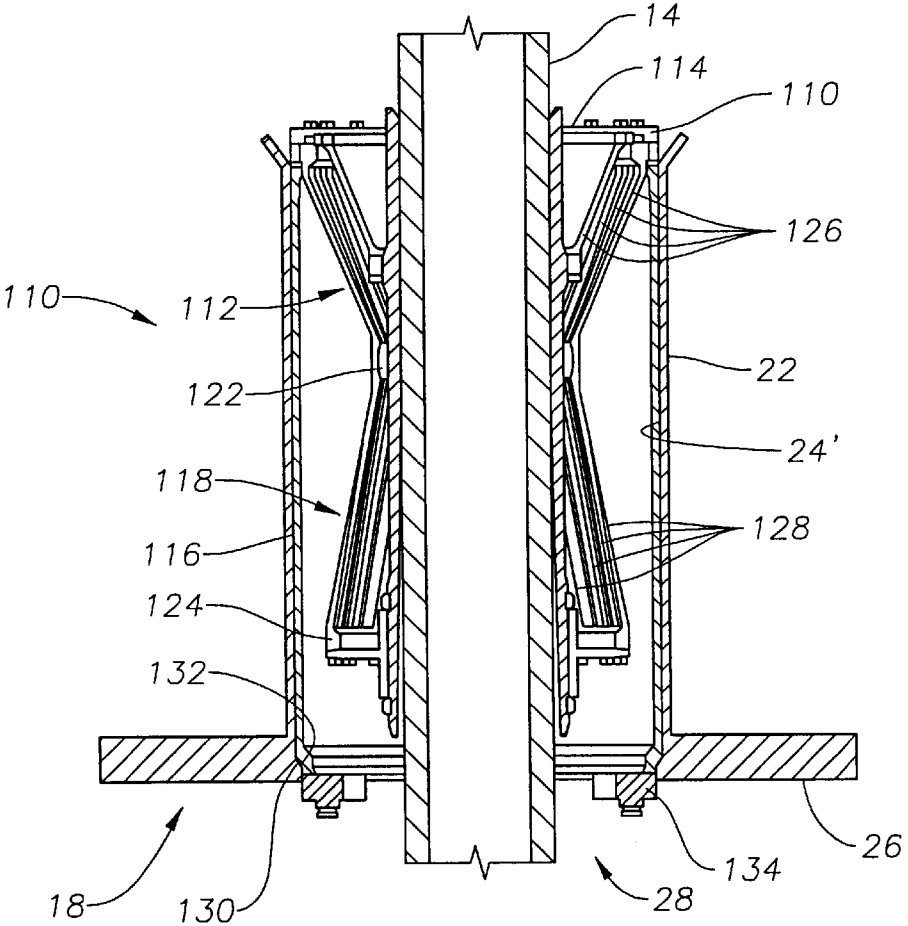
FIG. 6 is a schematic side, cross-sectional view of a fifth exemplary keel joint assembly constructed in accordance with the present invention.

A fourth alternative exemplary embodiment for the keel joint 28 is shown in FIG. 6. Keel joint assembly 110 incorporates a flexible cage assembly to permit relative movement between the riser 14 and the floating vessel 18. A flexible cage assembly 112 is formed of an inner riser sleeve 114 and an outer keel sleeve 116. A central cage 118 adjoins the two sleeves 114, 116. The cage 118 includes an upper ring 120, a central ring 122, and a lower ring 124. There are a series of upper spokes 126 that radiate upwardly and outwardly from the central ring 122 to the upper ring 124. There are also a series of lower spokes 128 that radiate outwardly and downwardly from the central ring 122 to the lower ring 124. The upper and lower spokes 126, 128 are each arranged in a spaced relation from one another about the circumference of the central ring 122. The spokes 126, 128 are fashioned from a material that is somewhat flexible yet has good strength under both tension and compression. It is currently preferred that the spokes 126, 128 are fashioned of a steel alloy, although other suitable materials may be used. The spokes 126, 128 are elastically deformable as necessary to allow the riser 14 to move angularly within the passage 24'. Angular deflection of the riser 14 results in non-uniform deflection of upper spokes 126 and lower spokes 128. The upper ring 120 affixes the upper spokes 126 to the outer keel sleeve 116. The lower ring 124 is not affixed to the outer keel sleeve 116.

The outer keel sleeve 116 is seated within the passage 24' by means of a landing profile 130 that is shaped and sized to be seated within a complimentary seating profile 132 at the lower end of the passage 24'. Locking flanges 134 are secured onto the lower side of the keel 26 to secure the outer keel sleeve 116 in place. In a manner known in the art, the locking flanges 134 may be selectively disengaged, or unlocked, and subsequently retrieved by upward movement of the riser 14 with respect to the passage 24', i.e., by pulling upwardly on the riser string.

During operation, the cage 118 holds the riser 14 in a semi-rigid manner that permits some flexibility. The riser 14 can move angularly with respect to the hull 22 due to the flexibility of the spokes 126 and 128 of the cage 118. Loading from movement of the riser 14 is transferred by the upper spokes 126 to the keel sleeve 116 which, in turn transfers the loading to the hull 22. Because the keel sleeve 116 engages the passage 24' of the hull 22 along substantially its entire length, point loading is avoided.

Figure 7:
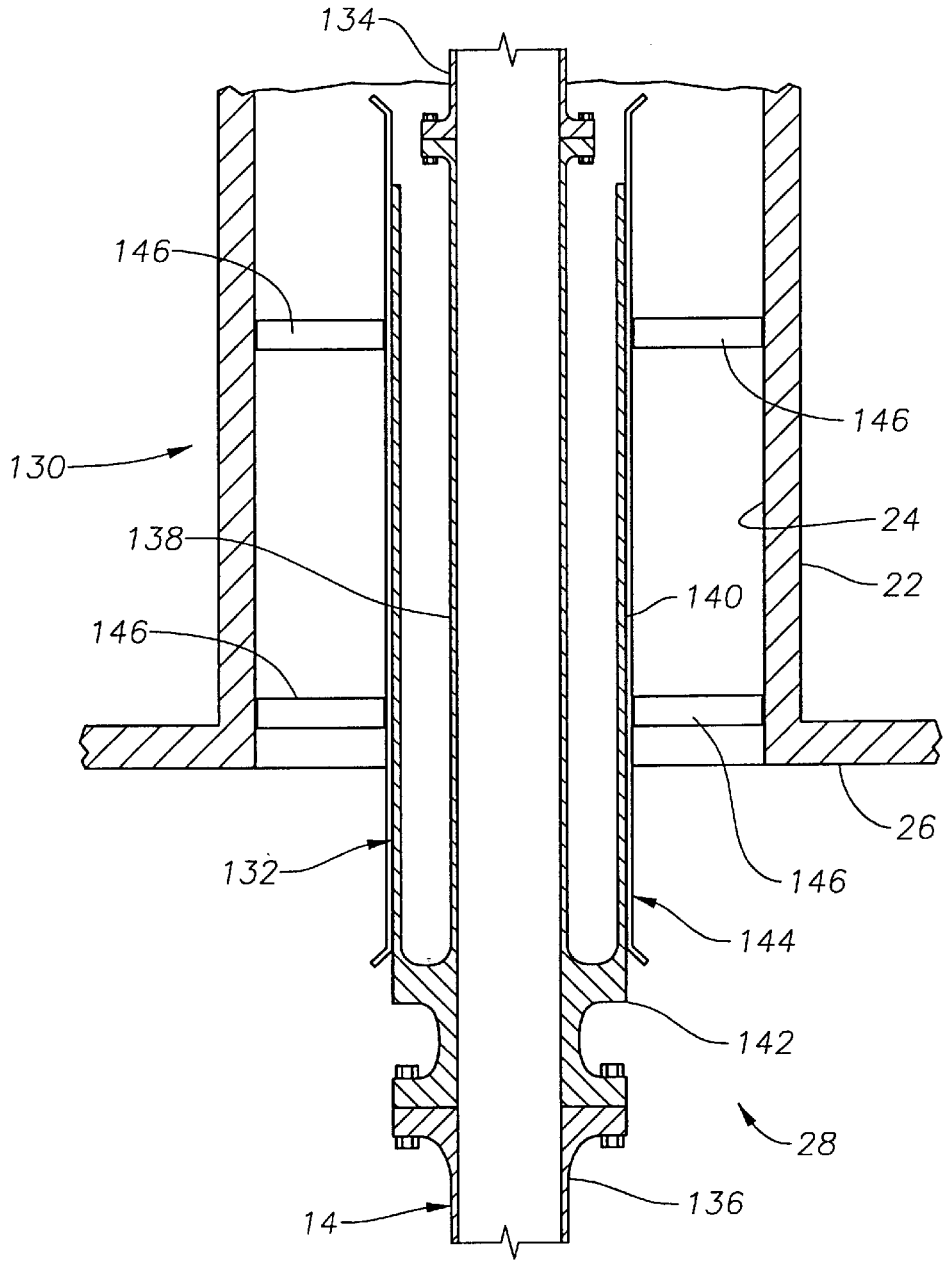
FIG. 7 is a schematic side, cross-sectional view of a sixth exemplary keel joint assembly constructed in accordance with the present invention.

FIG. 7 depicts a fifth alternative embodiment for use as the keel joint 28. Keel joint arrangement 130 includes an open top can structure, which is shown incorporated into the riser 14 as a sub 132 at is affixed at either end to other riser sections 134, 136. The can sub 132 includes a pair of concentric tubular members. The inner tubular member 138 has the same interior and exterior diameters as a standard riser section. The outer tubular member, or can, 140 is coaxial with the inner tubular member 138 and is affixed to the inner tubular member 138 by a flange adapter, or stress joint, 142 that joins the two pieces together proximate the lower end of the sub 132. While FIG. 7 shows the flange adapter 142 to be an annular metallic collar that is integrally formed into both the inner and outer tubular members 138, 140, it might also comprise a separate collar or elastomeric member as well as a flexible casing.

A cylindrical guide sleeve 144 radially surrounds the open top can sub 132. The guide sleeve 144 is securely affixed to the outer tubular member 140 by, for example, welding. Supports 146 are used to secure the guide sleeve 144 within the passage 24 of the hull 22. The supports 146 maintain the guide sleeve 144 a distance away from the wall of the passage 24 so that the guide sleeve 144 is substantially radially centered within the passage 24. The supports 146 are preferably formed of structural beams. The supports 146 are arranged in two tiers, an upper tier and a lower tier, and each tier surrounds the circumference of the passage 24. The outer tubular member 140 is stiff enough that it transfers stresses directly from the flange adapter 142 to the guide sleeve 144. Because the guide sleeve 144 and the outer tubular member 140 are affixed along substantially their entire length, point stresses are avoided. In addition, the supports transmit loads or stresses from the guide sleeve 144 to the passage 24 walls. The length of contact between the outer tubular member 140 and the guide sleeve 144 allows for a longer vertical riser stroke than arrangements wherein there is less contact area, such as the arrangement 30 shown in FIG. 2.

While described in terms of preferred embodiments, those of skill in the art will understand that many modifications and changes may be made while remaining within the scope of the invention.

What is claimed is:

1. A floating platform, comprising:

a hull having a bottom and a deck spaced above the bottom;

a riser opening extending generally vertically through the hull from the bottom to the deck;

a riser extending through the riser opening;

a landing profile in the riser opening adjacent to the bottom of the hull;

a guide sleeve having an engagement profile that lands and locks on the landing profile for movement with the hull; and a collar being located with the guide sleeve and having a flex member having a central passage through which the riser extends, the flex member being supported by the guide sleeve adjacent to the bottom of the hull, the flex member being movable axially relative to an axis of the riser and allowing angular movement of the guide sleeve relative to the riser.

2. The platform of claim 1, wherein the flex member comprises a convex spherical element of the collar that engages a concave recess in the guide sleeve.

3. The platform of claim 1, wherein the flex member allows angular movement of the collar relative to the riser in at least two planes.

4. The platform of claim 1, wherein the guide sleeve and the flex member are run in as an assembly into the riser opening with the riser.

5. The platform of claim 1, wherein the flex member comprises a conical sleeve having a plurality of elongated slots to provide flexibility.

6. The platform of claim 1, wherein the flex member has an upper end that is located within the riser opening below the deck.

7. In a floating platform having a hull with a keel, and a riser opening having a lower end at the keel and extending upward through the hull, the improvement comprising:

a landing profile in the riser opening adjacent to the lower end of the riser opening;

a guide sleeve having an engagement profile that lands and locks on the landing profile for movement with the hull;

a collar being located within the guide sleeve and having a flex member extending into the guide sleeve adjacent to the lower end of the riser opening, the flex member retaining the collar with the guide sleeve, but allowing angular movement of the guide sleeve relative to the collar due to movement of the hull, the flex member having an upper end spaced below an upper end of the riser opening; and a riser extending slidingly through the collar and the riser opening.

8. The platform of claim 7, wherein the flex member comprises a convex spherical element of the collar that engages a concave recess in the guide sleeve.

9. The platform of claim 7, wherein the guide sleeve, the collar, and the flex member are run into the riser opening as an assembly with the riser.

10. The platform of claim 7, wherein the flex member comprises a conical sleeve having a plurality of elongated slots to provide flexibility.

11. A method of preventing contact of a riser with a lower end of a riser opening extending upward through a hull from a keel of a hull, comprising:

providing a landing profile in the riser opening adjacent to the lower end of the riser opening;

assembling a flex member within a guide sleeve;

extending a riser through a passage in the flex member;

lowering the riser through the riser opening along with the flex member and the guide sleeve; then landing and locking the guide sleeve on the landing profile with the flex member adjacent to the lower end of the riser opening; then continuing to lower the riser while the flex member and the guide sleeve remain in the riser opening and securing a lower end of the riser to a subsea location; then as waves cause movement of the hull relative to the riser, allowing the hull to move relative to the riser with the flex member allowing angular movement of the guide sleeve relative to the riser.

* * * * *

UNITED STATES PATENT AND TRADEMARK OFFICE

CERTIFICATE OF CORRECTION

PATENT NO. : 6,746,182 B2
DATED : June 8, 2004
INVENTOR(S) : Brian N. Munk et al.

It is certified that error appears in the above-identified patent and that said Letters Patent is hereby corrected as shown below:

Column 4,
Line 19, after "two" (first instance) insert -- arms --

Column 5,
Line 55, after "132" delete "at" and insert -- that --

Column 6,
Lines 40 and 41, line 40 should be part of line 41 and not a separate paragraph, delete:
"and having
a flex member having a central passage through which the" and insert:
-- and having a flex member having a central passage through which the --

Column 7,
Line 5 should be part of line 4 and a separate paragraph, delete
"a collar being located within the guide sleeve and having
a flex member extending into the guide sleeve adjacent to" and insert:
-- a collar being located within the guide sleeve and having a flex member extending into the guide sleeve adjacent to --

Signed and Sealed this

Fifth Day October, 2004

JON W. DUDAS
*Director of the United States Patent and Trademark Office*